US006024233A

United States Patent [19]

Natschke et al.

[11] Patent Number: 6,024,233

[45] Date of Patent: Feb. 15, 2000

[54] LOCKING WEDGE ASSEMBLY FOR A SLACKLESS DRAWBAR ASSEMBLY

[76] Inventors: Scott Natschke, 543 S. Tanner Ave., Kankakee, Ill. 60901; Michael E. Ring, 8640 Fairbanks St., Crown Point, Ind. 46307; David W. Daugherty, Jr., 13437 Lake Shore Dr., Plainfield, Ill. 60544

[21] Appl. No.: 09/049,553

[22] Filed: Mar. 27, 1998

[51] Int. Cl.[7] ..... B61G 7/00

[52] U.S. Cl. ..... 213/50; 213/61

[58] Field of Search ..... 213/50, 56, 57, 213/58, 60, 59, 61, 62 R, 62 A

[56] References Cited

U.S. PATENT DOCUMENTS

| | | | |
|---|---|---|---|
| 4,531,648 | 7/1985 | Paton | 213/59 |
| 4,946,052 | 8/1990 | Kaim et al. | 213/61 |
| 5,558,238 | 9/1996 | Daugherty | 213/50 |
| 5,573,126 | 11/1996 | Beauclerc et al. | 213/62 R |

*Primary Examiner*—Mark T. Le
*Attorney, Agent, or Firm*—James Ray & Associates

[57] ABSTRACT

A locking wedge assembly for use in a slackless drawbar assembly designed to connect together, in a substantially semi-permanent fashion, adjacently disposed ends of a pair of railway cars. Such locking wedge assembly including a locking wedge member having a top surface and a bottom surface. A crushable support member has a top surface engageable with at least a portion of the bottom surface of such wedge member. An aperture is formed through the crushable support member and an anchoring member is engaged with the locking wedge member and extends through such aperture formed in the crushable support member for securing the locking wedge member in such slackless drawbar assembly. Such anchoring member includes at least a threaded portion for at least one of receiving a nut thereon and for threadedly engaging a threaded aperture formed in the wedge member adjacent the bottom surface of such wedge member to enable tightening of such locking wedge member in place.

20 Claims, 11 Drawing Sheets

LOCKING WEDGE ASSEMBLY FOR A SLACKLESS DRAWBAR ASSEMBLY

CROSS-REFERENCE TO RELATED APPLICATIONS

This patent application is closely related to our co-pending patent application Ser. No. 09/049,262, entitled "A Carrier Plate For A Slackless Drawbar Assembly" and to our co-pending application Ser. No. 09/049,519, entitled "A Method For Installing a Locking Wedge And Carrier Plate Assembly", both of which are being filed concurrently herewith. These patent applications are assigned to Westinghouse Airbrake Company, the assignee of the present invention and the teachings therein are incorporated into the present document by reference thereto.

FIELD OF THE INVENTION

The present invention relates, in general, to slackless type drawbar assemblies which are used in the railway industry to couple together the adjacently disposed ends of a pair of railway type freight cars in a substantially semi-permanent fashion and, more particularly, this invention relates to a crushable support member which is positioned beneath a locking wedge member so as to maintain the installation height of the locking wedge member during installation of the slackless drawbar system. This crushable support member may be flattened and/or crushed and left in place beneath the locking wedge member once installation is complete. The present invention enables positioning of the components of the slackless drawbar system in place prior to tightening of the several components in place.

BACKGROUND OF THE INVENTION

Slackless type drawbar assemblies have been well known in the railroad industry for several years, prior to the development of the present invention, as a means to connect together adjacently disposed ends of a pair of railway freight cars in a substantially semi-permanent fashion.

In other words, these railway freight cars do not require frequent separation during service. Normally, they will only be separated during a required repair and/or routine maintenance being performed on one or more of them.

These particular railway freight cars are normally of the type utilized in what is most commonly referred to, in the railroad industry, as dedicated service. Railway freight cars of such dedicated service type will at least include: those cars which are normally utilized to haul coal, coke, and/or various other types of raw minerals; automotive type transport carriers, tank cars which are used to transport various liquids and cars which are used in transporting various types of building materials.

Examples of some other raw minerals transported in these dedicated service railway freight cars include: various types of ore, cement and stone. The various types of liquids transported by such dedicated service railway freight cars will at least include a number of different chemicals. A number of building materials transported in this manner include: lumber, dry wall, plywood, paneling, etc.

A slackless type drawbar assembly normally comprises the following elements: a female connection member, a male connection member retained in such female connection member, a drawbar connected to such male connection member and at least one wedge member.

The present invention is particularly directed to the locking wedge member portion of the slackless drawbar assembly and to the maintenance of a predetermined height of this locking wedge member during its installation into the slackless drawbar assembly. The locking wedge member performs the function of keeping the drawbar assembly in a slackless condition during service.

The present invention enables positioning of the locking wedge member during installation and it, also, enables tightening of this locking wedge member after the slackless drawbar assembly is installed in the center sill portion of the railway freight car. Another drawback of the prior art is that one could not attach the drawbar assembly unit as a whole to the carrier plate. The present invention provides for a means to overcome these problems in the prior art.

SUMMARY OF THE INVENTION

The present invention provides a crushable support member which maintains the height of a locking wedge member during the installation of the slackless type drawbar system. Once the slackless drawbar assembly, carrier plate and locking wedge member are installed into the car center sill, the carrier plate is bolted or anchored to the sill flanges. The bolt or anchoring means is then drawn tight with a nut. This nut is usually provided beneath the carrier plate, but could also be positioned above the locking wedge member. Tightening of the nut causes the locking wedge member to be drawn down to remove the space between all of the components between the front and rear lugs of a standard draft gear pocket or a custom designed pocket. During this operation, the crushable support is crushed and/or flattened between the bottom of the locking wedge member and the top of the carrier plate. The crushable support is then left in place beneath the locking wedge member when installation is complete or it may be broken apart during the installation process and removed from the assembly.

OBJECTS OF THE INVENTION

It is, therefore, one of the primary objects of the present invention to provide a means for maintaining the height of a locking wedge member during installation of the slackless drawbar system.

Another object of the present invention is to provide a means to enable attachment of the slackless drawbar assembly as a whole to the carrier plate prior to installation of the slackless drawbar assembly into the center sill of the freight car.

Yet another object of the present invention is to provide a means for maintaining the height of a locking wedge member during installation of the slackless drawbar system which will prevent shifting of the locking wedge member during such installation.

Still another object of the present invention is to provide a means for maintaining the height of a locking wedge member during installation of the slackless drawbar system which is relatively inexpensive to produce.

A further object of the present invention is to provide a means for maintaining the height of a locking wedge member during installation of the slackless drawbar system which is easy to use.

In addition to the various objects and advantages of the present invention which have been discussed in some detail above, various other objects and advantages of the invention will become more readily apparent to those persons who are skilled in the relevant art from the following more detailed description of the invention, particularly, when such description is taken in conjunction with the attached drawing Figures and the appended claims.

Figure 1:
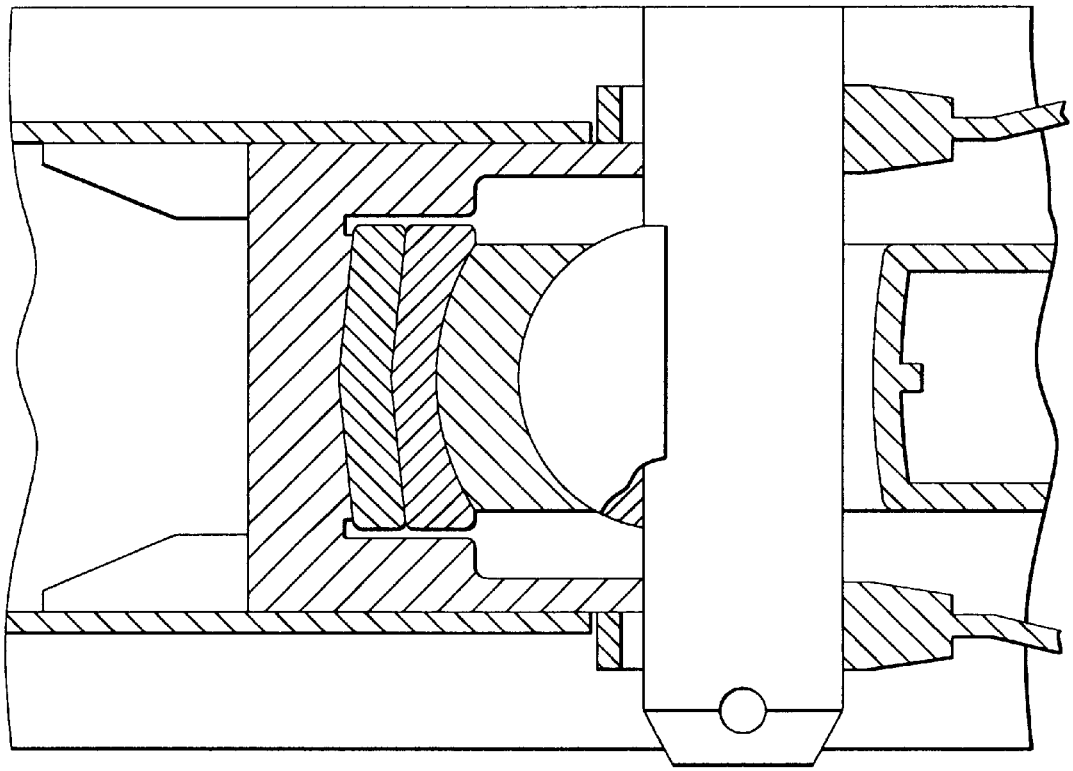
FIG. 1 PRIOR ART
FIG. 1 illustrates a slackless type drawbar assembly according to the prior art.

BRIEF DESCRIPTION OF THE PRESENTLY PREFERRED AND VARIOUS ALTERNATIVE EMBODIMENTS OF THE INVENTION

Prior to proceeding to the more detailed description of the present invention it should be noted that identical components, having identical functions, have been identified with identical reference numerals throughout the several views illustrated in the attached drawing Figures for the sake of clarity and understanding the invention.

Reference is now made, more particularly, to the drawings in which FIG. 1 shows the drawbar assembly of the prior art and has been discussed above in detail.

Figure 2:
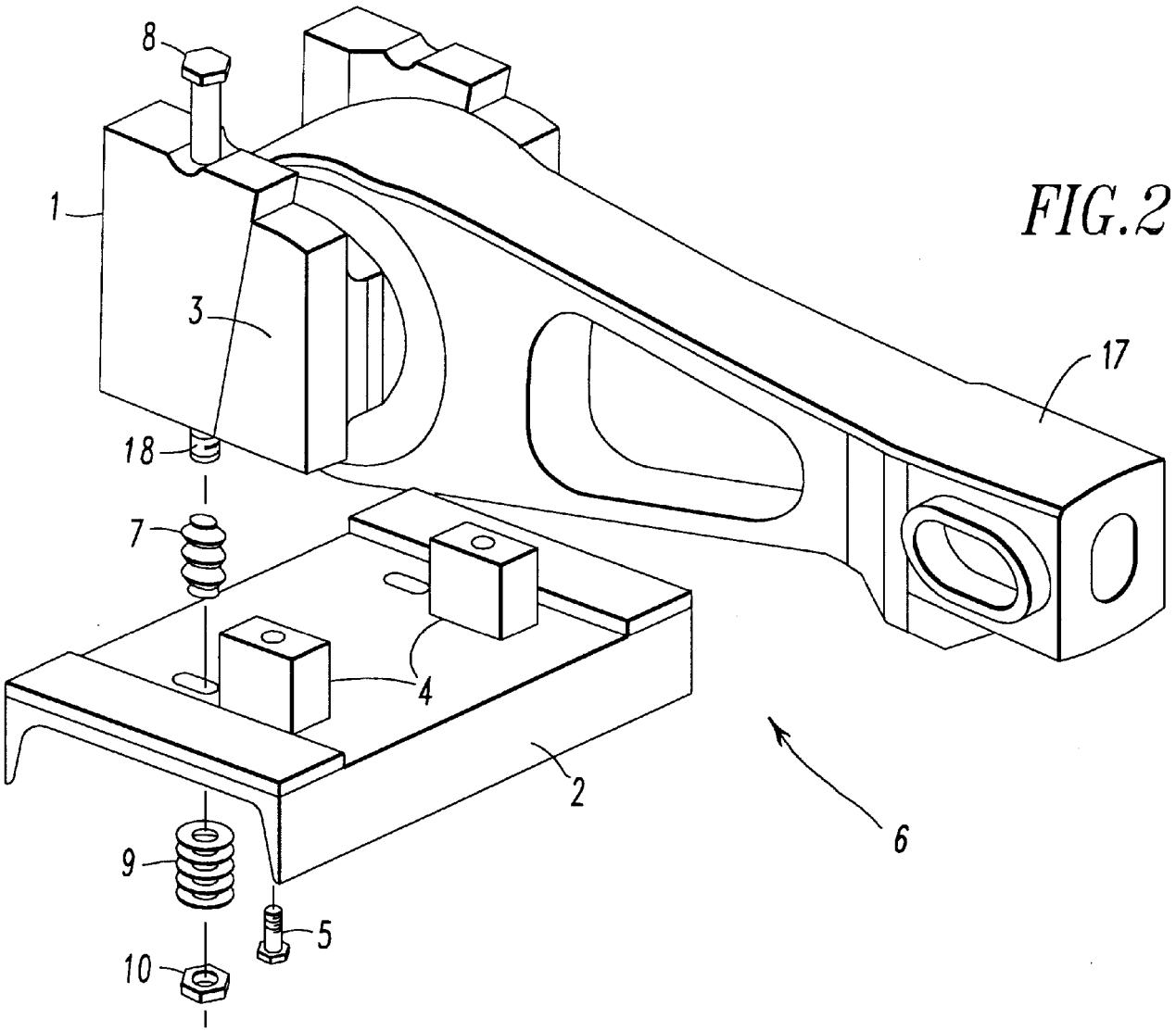
FIG. 2 illustrates an expanded side view/top view perspective of the locking wedge member and carrier portion of a slackless type drawbar assembly utilizing one presently preferred embodiment of the crushable support member according to the present invention.

FIG. 2 shows a slackless type drawbar assembly 6 utilizing the crushable support of the present invention. The assembly comprises a locking wedge member 1, a carrier plate 2, a shaft member 3, a shaft support member 4, a shaft anchoring means 5, a main drawbar portion 17 and a male connection portion of the slackless drawbar assembly 6.

Note that this male connection portion of the slackless drawbar assembly 6 is designed so that it mates with a female connection drawbar assembly 6 being positioned on and between the ends of a pair of adjacently disposed railway cars so that connection of the railway cars may be achieved.

The drawbar assembly also includes at least one crushable wedge support member 7, according to the present invention, which is positioned beneath the locking wedge member 1 and is engageable therewith.

This crushable support member 7 has an aperture therein and an anchoring means, or bolt, 8 which extends through this aperture. The anchoring means is engageable with the locking wedge member 1 and also includes at least one threaded portion 18 (shown in FIGS. 6A and 6B) for receiving a nut 10 thereon to enable tightening of the locking wedge member 1 in place in the slackless drawbar assembly 6.

The drawing shows the placement of a number of belleville type springs 9 between the nut 10 and the bottom surface of the carrier plate. 2. The locking wedge member 1 is assembled with the carrier plate 2 by aligning the crushable support 7 over the slots of the carrier plate assembly 2. The locking wedge member 1 is placed on top of the crushable support 7 such that an aperture in the locking wedge member 1, the crushable support 7 and a corresponding slot in the carrier plate 2 are aligned.

The anchoring means is then installed through the apertures in the locking wedge member 1, through the crushable support 7 and through the slot of the carrier plate 2. The belleville springs 9 are then placed beneath the carrier plate 2 and a locknut 10 is applied onto the anchoring means. The nut 10 is tightened just enough to hold the locking wedge member 1 in place without distorting the crushable support 7.

Figure 3:
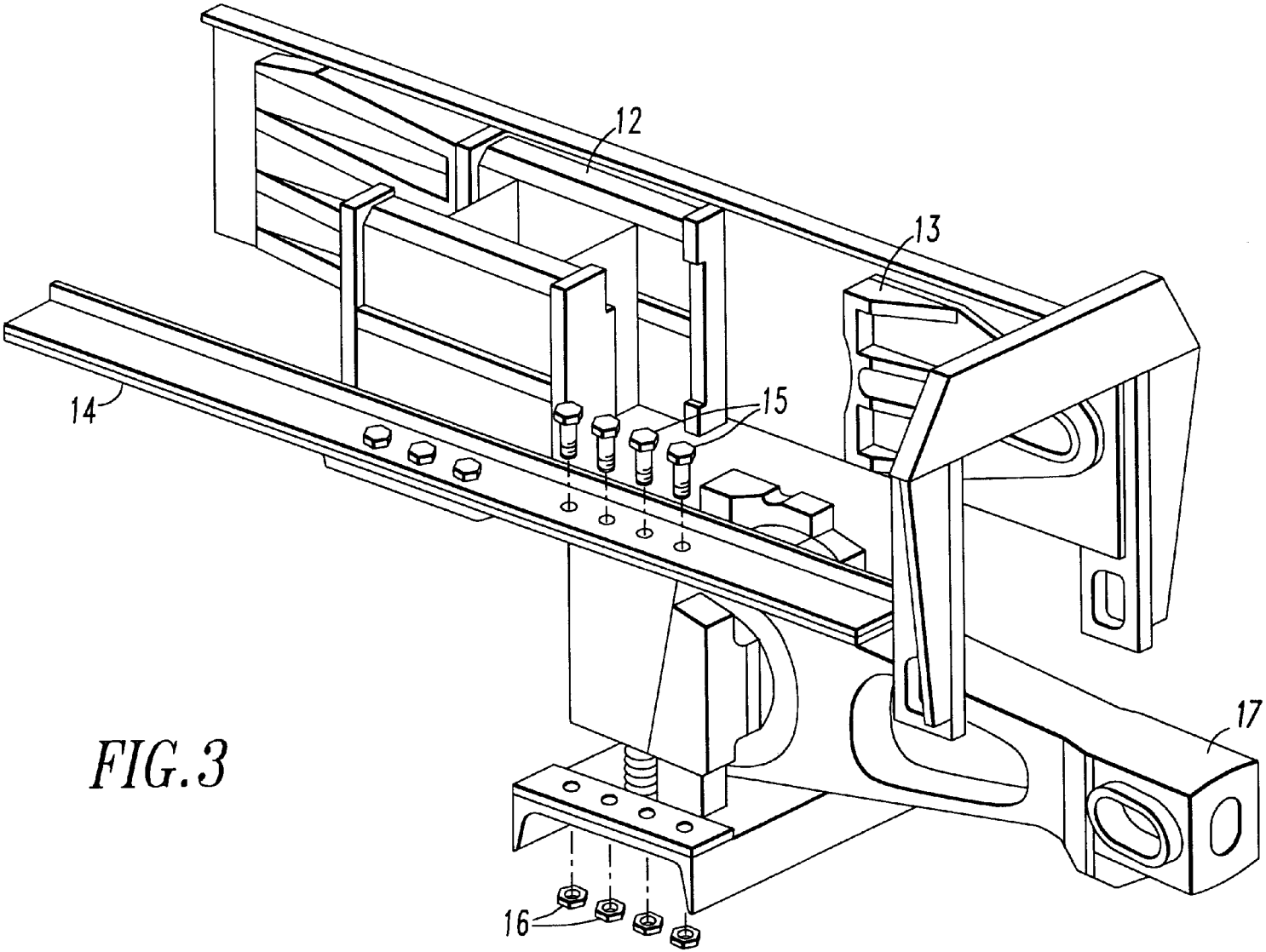
FIG. 3 illustrates an expanded side view/top view perspective of the presently preferred embodiment of the locking wedge member/carrier plate assembly being positioned within the drawbar pocket in the center sill portion of a freight car.

Once the nut 10 has been tightened so as to hold the locking wedge member 1 in place, this entire assembly may then be raised into the drawbar pocket while aligning holes in the carrier plate assembly 2 with holes in a center sill flange 14, as depicted in FIG. 3. The system is anchored in place via anchoring means 15 and locknuts 16.

The crushable support 7 maintains the installation height of the locking wedge member 1 during installation of the slackless drawbar system. Once the main drawbar portion 17, carrier plate 2 and locking wedge member 1 are installed into the car sill, the carrier plate 2 gets anchored or bolted to the sill flanges 14.

Figure 4:
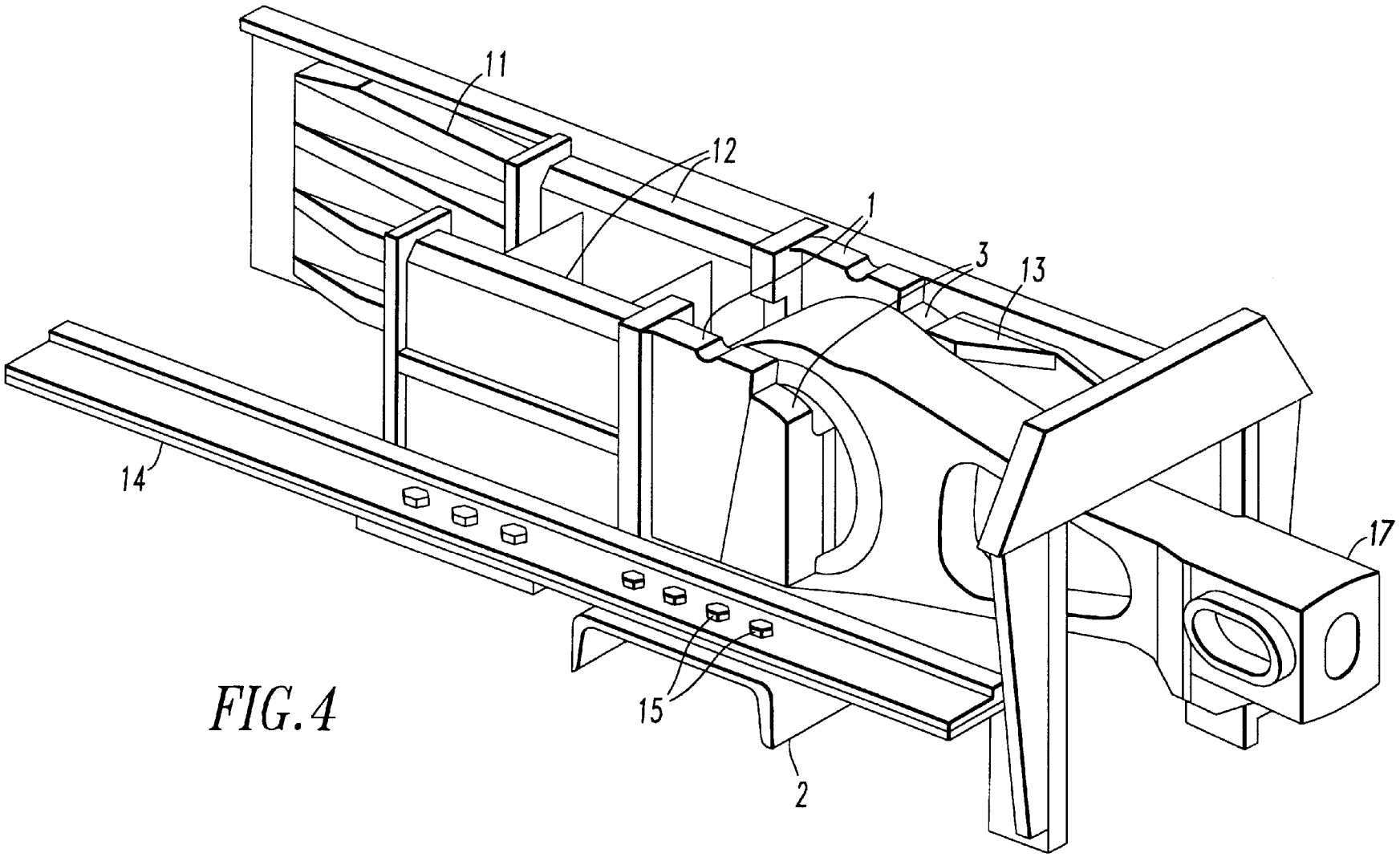
FIG. 4 illustrates a side view/top view perspective of the assembled slackless type drawbar system illustrated in FIG. 3.

FIG. 4 shows the assembled drawbar system. The anchoring means 8, going through the locking wedge member 1, is then drawn tight with the nut 10 thereby drawing the locking wedge member 1 down to remove any slack that may exist between all of the various components disposed between the front and rear draft lugs of a standard draft gear pocket or a custom designed pocket for such slackless drawbar assembly.

During this operation, the crushable support 7 is crushed and/or flattened between the bottom of the locking wedge member 1 and the top of the carrier plate 2. The crushable support 7 is then left in place beneath the locking wedge member 1 when the installation is complete.

Although the invention has been described as using a single locking wedge, a standard drawbar system would typically include at least two wedges, one positioned on either side of the main drawbar portion 17.

Figure 5:
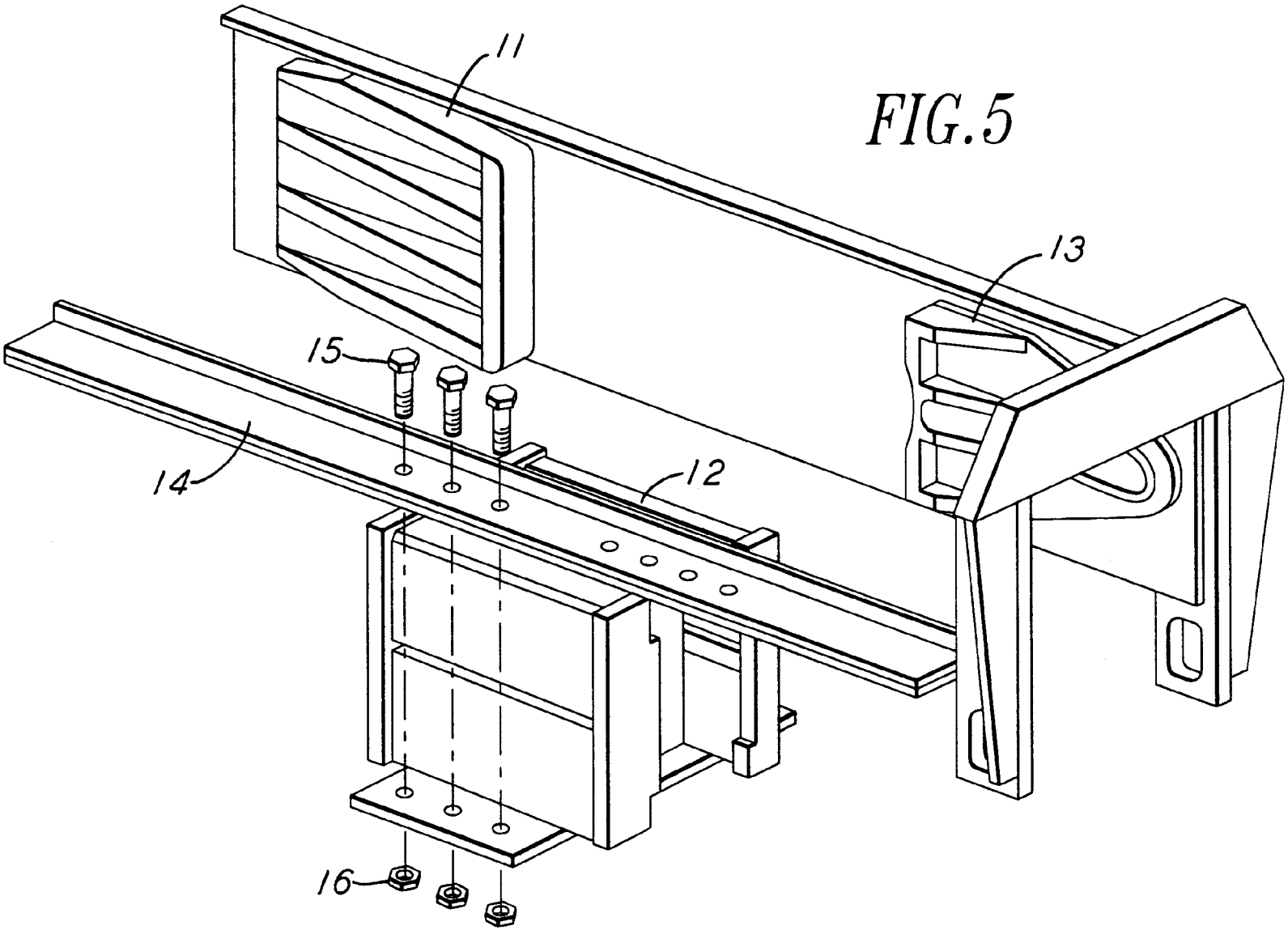
FIG. 5 illustrates a top view of the slackless type drawbar assembly illustrated in FIGS. 3 and 4.

FIG. 5 is directed to a top view of a drawbar assembly. This view includes the rear draft stop 11, the filler block 12, the locking wedge member 1, the shaft 3 and the front draft stop 13.

The filler block 12 is provided in systems wherein existing drawbar assemblies have been converted to the wedge-type systems. This filler block 12 is provided to fill in space between the rear draft stop 11 and the locking wedge member 1 so as to achieve a tight fit along the length of the assembly. Newly manufactured slackless drawbar assemblies do not require a filler block because these assemblies are constructed so that the rear draft stop 11 is butted up against the locking wedge member 1.

Figure 6A:
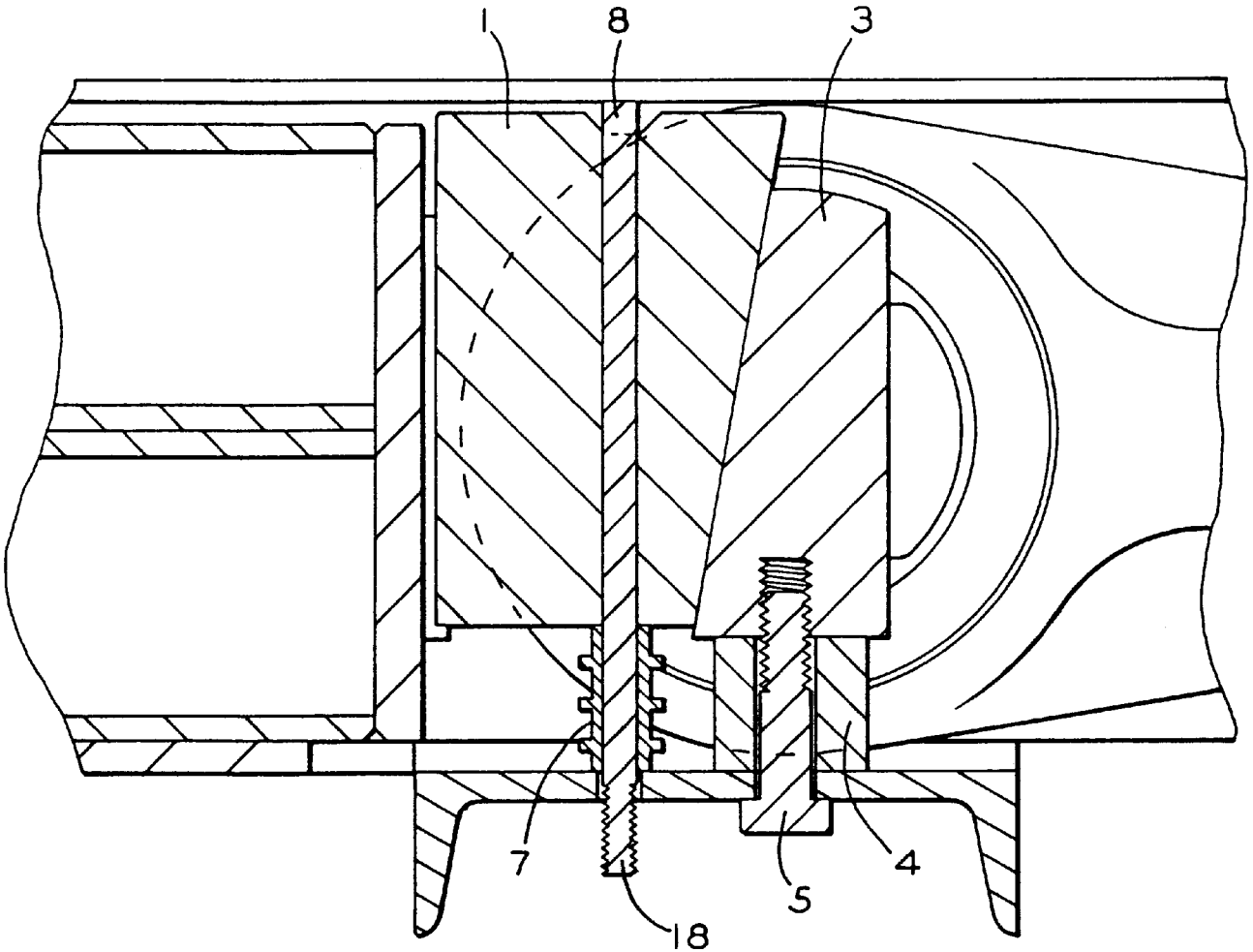
FIGS. 6A and 6B illustrate enlarged views of two different alternative embodiments of the crushable support member of the present invention.
Figure 6B:
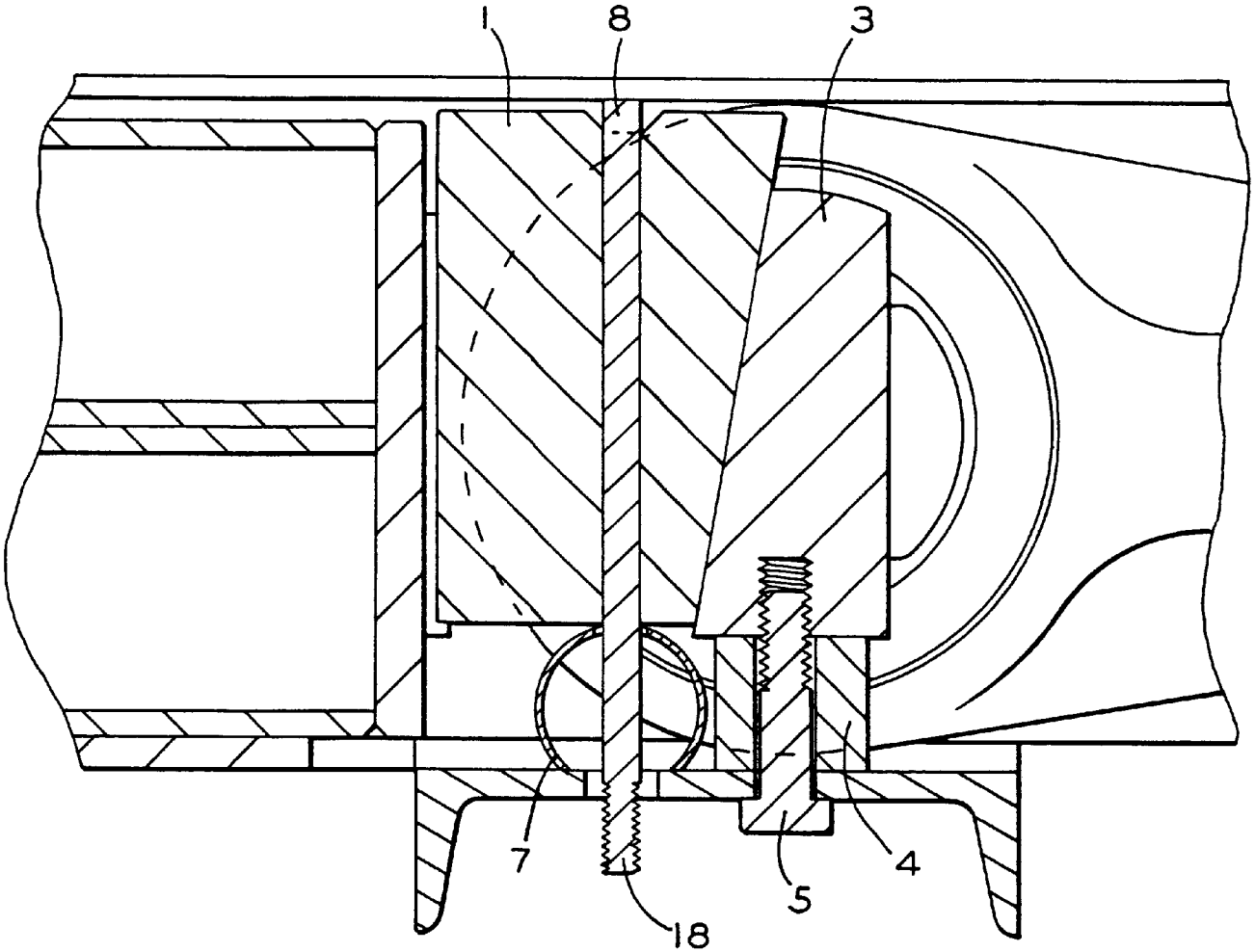

FIGS. 6A and 6B show two different alternative embodiments for the crushable support member. Both of these embodiments show tubing which contains an aperture therein for which the anchoring means 8 extends therethrough. The FIG. 6A embodiment comprises tubing which extends vertically with respect to the locking wedge member 1 and includes horizontally extending bellows along the height of the tubing.

The FIG. 6B embodiment comprises tubing which extends horizontally with respect to the locking wedge member and comprises a horizontally extending semicircular shaped member having a hole therein for which a portion of said anchoring means can extend therethrough.

Note that FIGS. 2–4 show the anchoring means extending through both the locking wedge member 1 and the carrier plate 2 and the tightening nut 10 being applied beneath the carrier plate 2. This showing is not intended to limit the invention to only this type of attachment of the anchoring means to the locking wedge member 1 and/or carrier plate 2 and this location of the tightening means with respect to the locking wedge member 1.

Several different alternative embodiments showing the attachment of the anchoring means to the locking wedge member and to the carrier plate 2 and the location of the tightening nut with respect to the locking wedge member are depicted i FIGS. 7A–7C and 8A–8C.

Figure 7C:
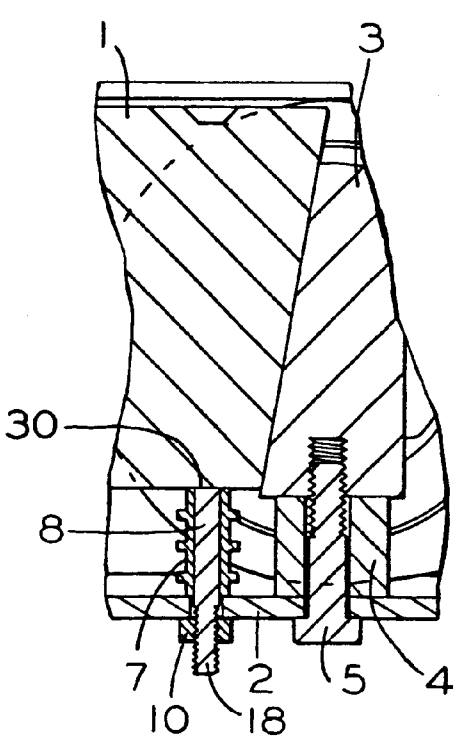
FIGS. 7A–7C illustrate three different alternative embodiments with respect to the attachment of the locking wedge member to the anchoring means wherein the nut is positioned beneath the crushable support member.
Figure 7B:
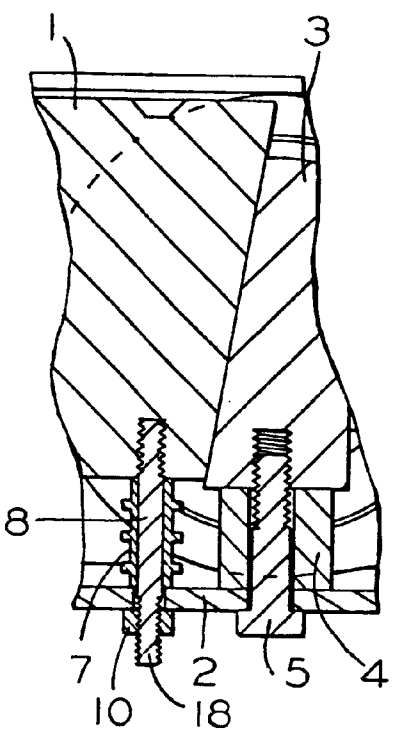
Figure 7A:
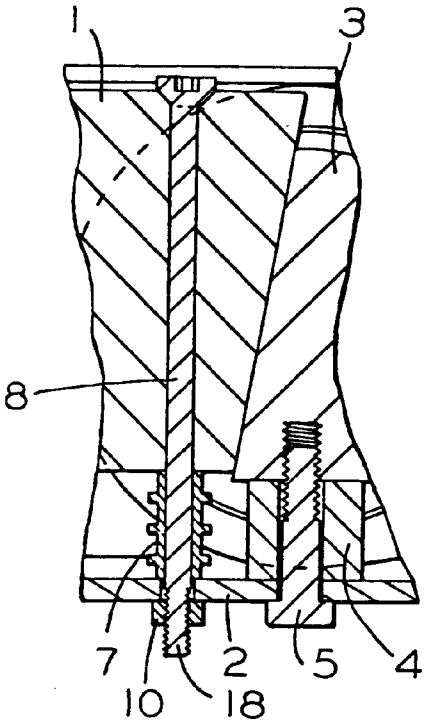

FIGS. 7A–7C show embodiments wherein the threaded portion of the anchoring means which receives the tightening nut 10 extends beneath the locking wedge member 1. Although FIGS. 7A–7C show the attachment of the locking wedge member 1 to a carrier plate 2, it is conceivable that the crushable support of the invention may be utilized in combination with an anchoring means to attach the locking wedge member to a component other than a carrier plate 2. All of the embodiments of FIGS. 7A–7C show attachment to the carrier plate 2 via the anchoring means which extends through an aperture in the carrier plate 2.

FIG. 7A shows an embodiment wherein the anchoring means 8 extends through an aperture in the locking wedge member 1. This is the embodiment which was used in the description of the drawbar assembly as discussed in FIGS. 2–4 above.

FIG. 7B shows an alternative embodiment wherein the anchoring means 8 extends partially upward into an aperture in the bottom surface of the locking wedge member 1. This anchoring means may be secured in this aperture by any well known means such as by providing a threading means on the anchoring means and screwing the anchoring means in the aperture, by gluing, brazing, fusing or welding of the anchoring means in the aperture, etc.

FIG. 7C shows another alternative embodiment for attaching the anchoring means 8 to the locking wedge member 1 wherein the anchoring means 8 is attached to the bottom surface of the locking wedge member by any well known technique such as gluing, brazing, fusing, or welding, as represented by numeral 30.

Figure 8C:
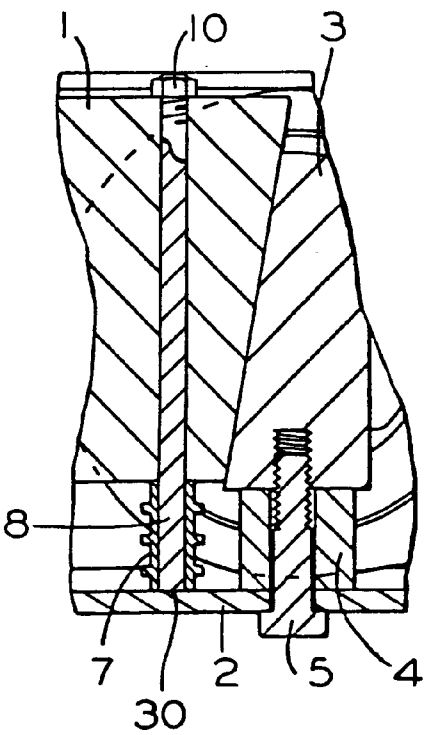
FIGS. 8A–8C illustrates three different alternative embodiments with respect to the attachment of the carrier plate to the anchoring means wherein the nut is positioned above the crushable support member.
Figure 8B:
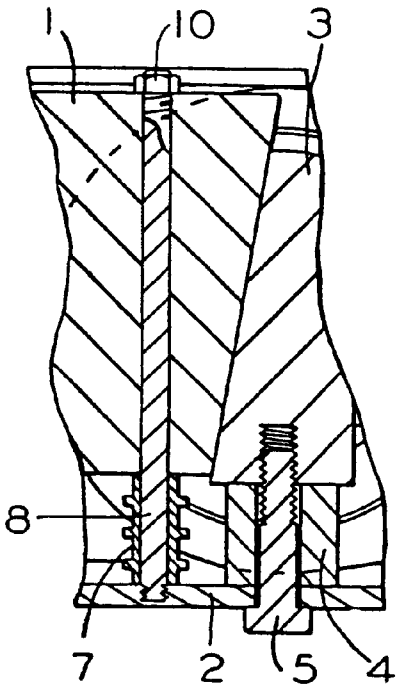
Figure 8A:
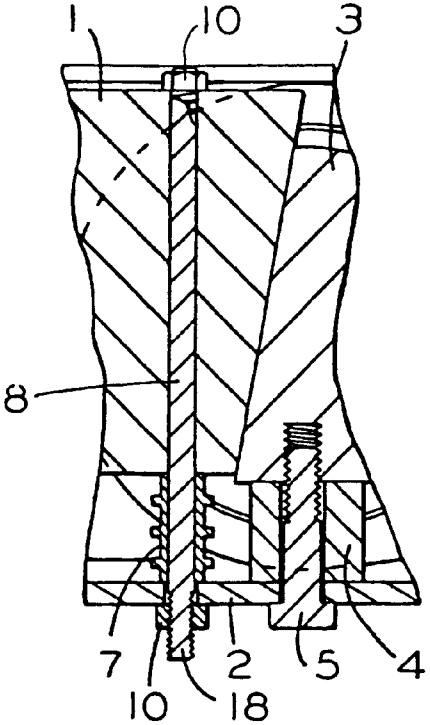

FIGS. 8A–8C show embodiments wherein the threaded portion of the anchoring means which receives the tightening nut 10 extends through an aperture in the locking wedge member 1 and above the top surface of the locking wedge member 1. As noted above, although FIGS. 8A–8C show the attachment of the locking wedge member 1 to a carrier plate 2, it is conceivable that the crushable support 7 of the invention may be utilized in combination with an anchoring means to attach the locking wedge member 1 to a component other than a carrier plate 2.

FIG. 8A shows an embodiment wherein the anchoring means 8 extends through an aperture in the carrier plate 2. FIG. 8B shows an embodiment wherein the anchoring means 8 extends at least partially downward into an aperture in the top surface of such carrier plate 2. This anchoring means may be secured in this aperture by any well known means such as by providing a threading means on the anchoring means and screwing the anchoring means into the aperture, and/or by gluing, brazing, fusing or welding of the anchoring means in the aperture, etc. FIG. 8C shows another embodiment for attaching the anchoring means 8 to such carrier plate 2 wherein the anchoring means is attached to the top surface of the carrier plate 2 by any well known techniques such as gluing, brazing, fusing, or welding, as represented by numeral 30.

Figure 9A:
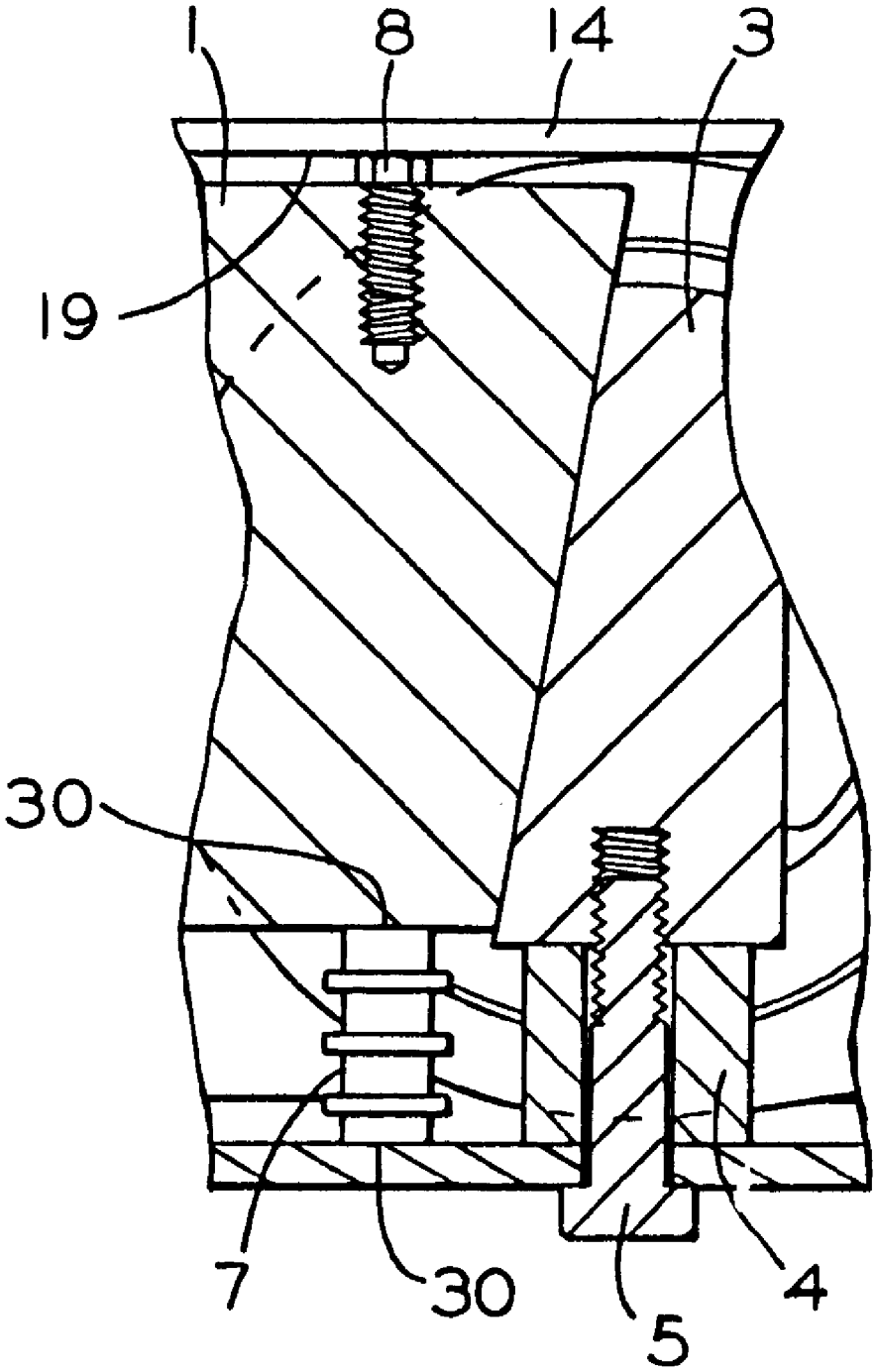
FIGS. 9A–9B illustrate alternative embodiments wherein the crushable support member does not contain an aperture extending throughout its length.
Figure 9B:
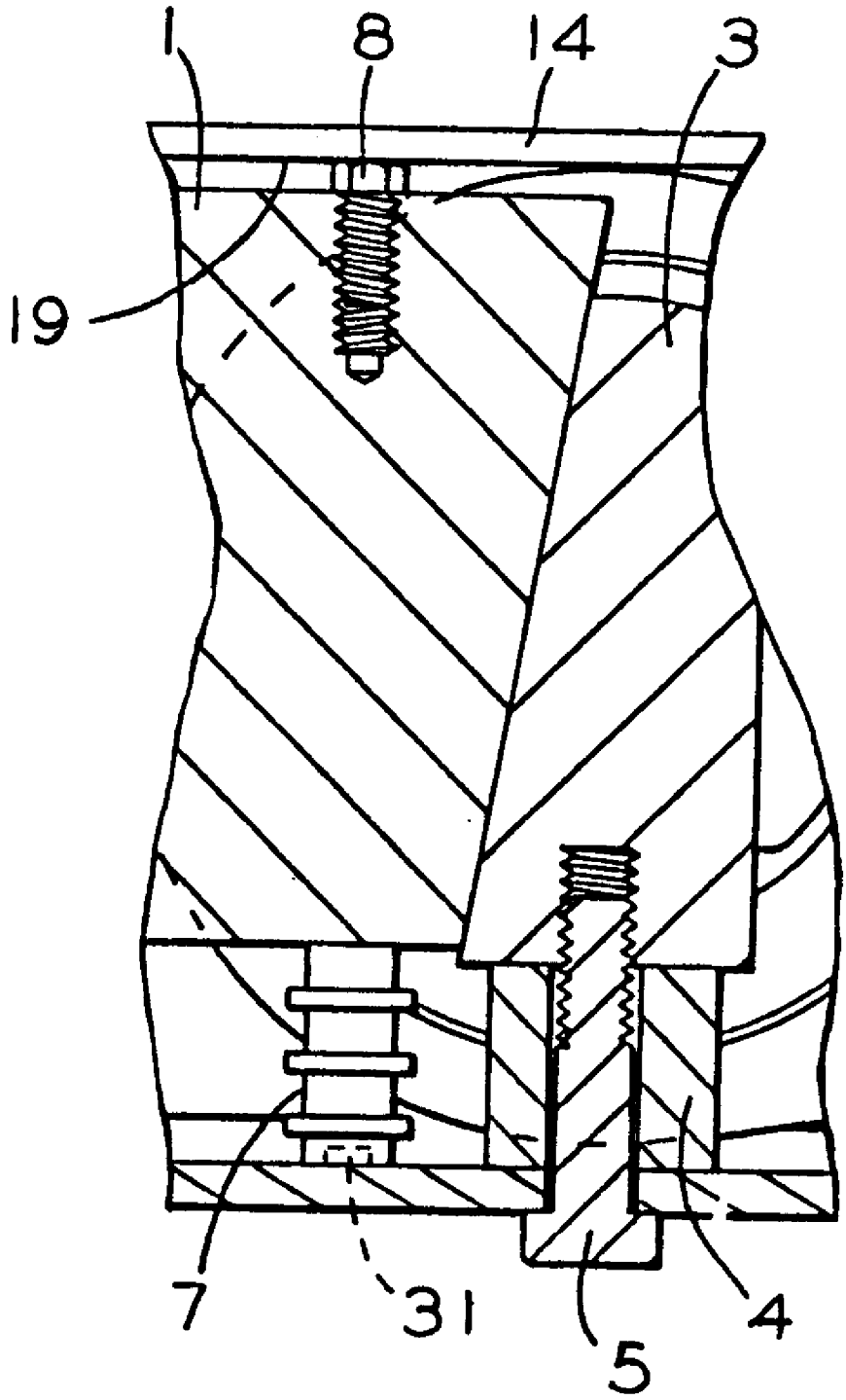

FIGS. 9A–9B show alternative embodiments wherein the crushable support member 7 does not contain an aperture extending throughout its length. In this embodiment, the crushable support 7 is positioned between the locking wedge member 1 and such carrier plate 2. The crushable support 7 may be held between the carrier plate 2 and the locking wedge 1 by any well known technique. One example, as shown in FIG. 9A, could include simply placing the crushable support 7 onto the carrier plate 2 without any specific holding means. Another example could include gluing, fusing, or welding of the crushable support 7, as represented by numeral 30, to the carrier plate 2 or the locking wedge 1. Another example, as shown in FIG. 9B, could include providing the carrier plate 2 or the locking wedge with a positioning member 31 thereon so that the crushable support 7 may be held onto the carrier plate 2 or the locking wedge by this positioning member 31. The crushable support 7 could have a an aperture partially extending therethrough for receiving this positioning member 31 or the positioning means could be designed so that it can pierce the crushable support.

The locking wedge member 1 is provided with a threaded aperture through its top surface and this aperture extends down into the locking wedge member 1 so that it may threadedly engage a threaded portion of an anchoring means 8. The top surface of this anchoring means 8 would abut the bottom surface 19 of the top of the center sill 14. This abutment would provide a surface against which the anchoring means 8 may press against so as to enable tightening of the locking wedge member 1 in place in the slackless drawbar assembly. This tightening would result in the crushing of the crushable support member 7.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A locking wedge assembly for use in a slackless drawbar assembly, said slackless drawbar assembly being designed to connect together, in a substantially semi-permanent fashion, adjacently disposed ends of a pair of railway cars, said locking wedge assembly comprising:

(a) a locking wedge member having a top surface and a bottom surface;

(b) a crushable support member having a top surface engageable with at least a portion of said bottom surface of said wedge member;

(c) an aperture formed through said crushable support member; and (d) an anchoring means engageable with said locking wedge member and extending through said aperture formed in said crushable support member for securing said locking wedge member in such slackless drawbar assembly, said anchoring means including at least a threaded portion for at least one of receiving a nut thereon and for threadedly engaging a threaded aperture formed in said wedge member adjacent said bottom surface of said wedge member to enable tightening of said locking wedge member in place.

2. A locking wedge assembly as recited in claim 1 wherein said anchoring means assists in attaching said locking wedge member to a carrier plate.

3. A locking wedge assembly as recited in claim 2 wherein said threaded portion of said anchoring means extends below a bottom surface of said crushable support member.

4. A locking wedge assembly as recited in claim 3 wherein said threaded portion of said anchoring means extends through an aperture in said carrier plate.

5. A locking wedge assembly as recited in claim 1 wherein an aperture, having a first predetermined length, is provided in said locking wedge member and said threaded portion of said anchoring means extends at least one of through said aperture in said locking wedge member and into said aperture for a second predetermined length.

6. A locking wedge assembly as recited in claim 5 wherein said first predetermined length extends from said top surface to said bottom surface of said locking wedge member.

7. A locking wedge assembly as recited in claim 5 wherein said second predetermined length is less than said first predetermined length.

8. A locking wedge assembly as recited in claim 2 wherein said crushable support member comprises tubing which is capable of maintaining said locking wedge member at a certain height during installation of said locking wedge member into said drawbar assembly.

9. A locking wedge assembly as recited in claim 8 wherein said crushable support member is capable of being crushed when said locking wedge member is tightened in place.

10. A locking wedge assembly as recited in claim 2 wherein said crushable support member comprises tubing which is capable of maintaining said locking wedge member at a certain height with respect to said carrier plate during installation of said locking wedge member into said drawbar assembly.

11. A locking wedge assembly as recited in claim 10 wherein said tubing comprises a vertically extending member having horizontally extending bellows along a height thereof.

12. A locking wedge assembly as recited in claim 10 wherein said tubing comprises a horizontally extending semi-circular member having a hole therein for which a portion of said anchoring means can extend therethrough.

13. A locking wedge assembly as recited in claim 5 wherein said aperture extends partially upward through said bottom surface of said locking wedge member and at least a threaded portion of said anchoring means is positioned within this aperture.

14. A locking wedge assembly as recited in claim 3 wherein at least a portion of said anchoring means is attached to said bottom surface of said locking wedge by one of welding, brazing, fusing and gluing.

15. A locking wedge assembly as recited in claim 3 wherein at least a portion of said anchoring means is formed integrally with said locking wedge member.

16. A locking wedge assembly for use in a slackless drawbar assembly, said slackless drawbar assembly being designed to connect together, in a substantially semi-permanent fashion, adjacently disposed ends of a pair of railway cars, said locking wedge assembly comprising:

(a) a locking wedge member having a top surface and a bottom surface and a threaded aperture through said top surface and extending partially downward into said locking wedge member;

(b) a crushable support member having a top surface engageable with at least a portion of said bottom surface of said wedge member; and (c) an anchoring means including at least a threaded portion for threadedly engaging said threaded aperture formed in said wedge member to enable tightening of said locking wedge in place in such slackless drawbar assembly.

17. A locking wedge assembly as recited in claim 16, wherein said locking wedge assembly further includes a means for retaining said crushable support member in place during installation.

18. A locking wedge assembly as recited in claim 17, wherein said means for retaining said crushable support member in place includes at least one of gluing, fusing, positioning member and welding.

19. A locking wedge assembly as recited in claim 17, wherein said positioning member is secured to one of said crushable support, said locking wedge and a carrier plate.

20. A locking wedge assembly as recited in claim 19, wherein said positioning member is secured to said carrier plate.

* * * * *